United States Patent [19]

Hope, Sr.

[11] 4,302,927

[45] Dec. 1, 1981

[54] SHOCK-ABSORBING THERMOPLASTIC SUPPORT FOR ROTATING SPINNING RING

[75] Inventor: William K. Hope, Sr., Gastonia, N.C.

[73] Assignee: H H & F Enterprises, Gastonia, N.C.

[21] Appl. No.: 155,298

[22] Filed: Jun. 2, 1980

Related U.S. Application Data

[63] Continuation-in-part of Ser. No. 71,720, Aug. 31, 1979.

[51] Int. Cl.[3] ..... D01H 7/58

[52] U.S. Cl. ..... 57/122; 57/124

[58] Field of Search ..... 57/119, 120, 122, 125, 57/124, 75, 135

[56] References Cited

U.S. PATENT DOCUMENTS

| | | | |
|---|---|---|---|
| 2,563,187 | 8/1951 | Pennati | 57/124 |
| 2,725,712 | 12/1955 | Rooney | 57/124 |
| 3,088,268 | 5/1963 | Holschlag et al. | 57/135 |
| 3,093,957 | 6/1963 | Tetreault | 57/122 |
| 3,324,643 | 6/1967 | Kluttz | 57/124 |
| 4,112,666 | 9/1978 | Costales et al. | 57/124 X |
| 4,114,359 | 9/1978 | Creus | 57/122 X |
| 4,150,531 | 4/1979 | Marzoli | 57/122 X |

*Primary Examiner*—John Petrakes

*Attorney, Agent, or Firm*—Bell, Seltzer, Park & Gibson

[57] ABSTRACT

This improved support assembly for rotating spinning rings of a spinning frame includes a spinning ring holder (20) and a mounting bracket (30) which are each molded of a thermoplastic material having shock-absorbing and vibration-dampening properties. A ball bearing (50) rotatably supports the ring holder (20) on the mounting bracket (30) and the resilient property of the thermoplastic material prevents interference fit of the ball bearing (50). The ring holder (20) extends over and around the upper portion of the ball bearing (50) and felt seals (60, 61) are provided above and below the ball bearing (50) to prevent the entry of lint and the like into the ball bearing (50).

10 Claims, 3 Drawing Figures

SHOCK-ABSORBING THERMOPLASTIC SUPPORT FOR ROTATING SPINNING RING

FIELD OF THE INVENTION

The present application is a continuation-in-part of applicant's co-pending application Ser. No. 71,720, filed Aug. 31, 1979 and relates generally to an improved support assembly for a rotating spinning ring, and more particularly to a support assembly for a rotating spinning ring in which the main components are formed of a lightweight, relatively soft, shock-absorbing thermoplastic material.

BACKGROUND OF THE INVENTION

In the conventional yarn spinning frame, the spinning rings are supported in a stationary position on a ring rail and a traveller rotates on the ring. For some years it has been recognized that there are advantages to rotating the normally stationary spinning ring and various types of support assemblies have been proposed for supporting the spinning ring for rotation and imparting a driving movement thereto. These prior types of support assemblies have included a metal support for the spinning ring, and a ball bearing between the ring support and a metal mounting bracket fixed on the ring rail. This type of metal ring supporting assembly is very expensive because the metal ring support and mounting bracket must be machined to very close tolerances. To be effective, these parts must rotate at a relatively high speed and the metal parts can be heated a sufficient amount to cause a variation in the dimensions of the metal parts and create an interference fit of the ball bearing. An interference fit can occur when the inner ring of the ball bearing is mounted on a metal ring support which will expand when heated, and the outer ring of the ball bearing is mounted in a metal mounting bracket which will expand when heated. Under these conditions, inwardly directed pressure is applied against both the inner and outer races of the ball bearing so that there is less internal clearance for the ball bearings and the ball bearing wears at a faster than normal rate. An example of this type of metal ring support assembly and one type of drive therefor is illustrated in the Costales et al U.S. Pat. No. 4,112,666.

Additionally, this metal ring support assembly is extremely heavy and the ball bearing can become clogged with lint. If the metal ring support is not completely round and balanced, extreme vibrations will be set up in the ring rail and the spinning frame.

SUMMARY OF THE INVENTION

With the foregoing in mind, it is an object of the present invention to provide an improved support assembly for a rotating spinning ring in which the main components are formed of a lightweight, relatively soft, shock-absorbing and vibration-dampening thermoplastic material.

The support assembly of the present of the present invention is capable of being molded by an injection molding process to dimensions with tolerances which are sufficiently accurate to be used with little or no subsequent machining, thereby reducing the cost of producing the support assembly. The thermoplastic components of the support assembly are impervious to oil and will not rust so that the life of the support assembly is increased.

The support assembly is provided with a ball bearing which rotatably supports the ring holder on the mounting bracket with the outer race of the ball bearing being supported in the mounting bracket and the inner race of the ball bearing being pressed onto a downwardly depending tubular portion of the ring holder. The thermoplastic ring holder and mounting bracket on opposite sides of the ball bearing prevent any interference fit of the bearing and ensure a long bearing life. The formation of the component parts of the support assembly of the thermoplastic material also absorbs shock and dampens vibration to permit the support assembly to operate satisfactorily without excessive noise or without excessive vibration even though the component parts may not be exactly balanced.

In accordance with the present invention, the ring holder includes a upper circular base including inner and outer peripheral surfaces with means for supporting the metallic spinning ring in the inner peripheral surface of the circular base. A peripheral flange is formed integral with the outer peripheral surface of the circular base and extends downwardly therefrom, and a tubular portion is formed integral with the inner peripheral surface of the circular base and extends downwardly and through the opening in the ring rail. A mounting bracket is molded of the same thermoplastic material as the spinning ring holder and is fixed on the ring rail. The mounting bracket includes an inner peripheral flange extending upwardly from the bracket and surrounding the opening in the ring rail. A metallic ball bearing rotatably supports the ring holder in the mounting bracket with the outer race being supported in the inner peripheral vertical flange of the mounting bracket and extending upwardly therefrom. The inner race of the ball bearing is press fitted around the outer surface of the tubular portion of the spinning ring holder.

Drive means is provided for rotating the spinning ring holder at high speeds and, in the present instance, the drive means includes a drive sleeve fixed on the tubular portion of the spinning ring holder with a belt drive groove formed therein. A spacing pad is integrally formed beneath the circular base of the ring holder for engagement by the inner race of the ball bearing and serves as a spacer to provide the proper clearance between the lower surface of the peripheral downwardly extending flange of the circular base and the upper surface of the peripheral vertical flange of the mounting bracket. The clearance between these parts is positioned substantially at the medial point of the outer race of the ball bearing so that any lint which might enter the clearance between these two rotating parts will be prevented from moving into the ball bearing by the outer race of the ball bearing. Felt seals are also provided above and below the ball bearing and between the inner and outer races thereof to further prevent the entry of lint into the ball bearing.

The outer periphery of the flange of the ring holder is aligned with the outer periphery of the mounting bracket to prevent a build-up of lint around the upper surface of the mounting bracket. The flange of the ring holder extends downwardly to cover the upper portion of the bearing so that lint will not enter the bearing, even with a relatively wide clearance space being provided between the ring support and the mounting bracket. It is preferred that the thermoplastic material, of which the ring holder and the mounting bracket are molded, be reinforced by the addition of glass fibers thereto to add stability to the material.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 3:
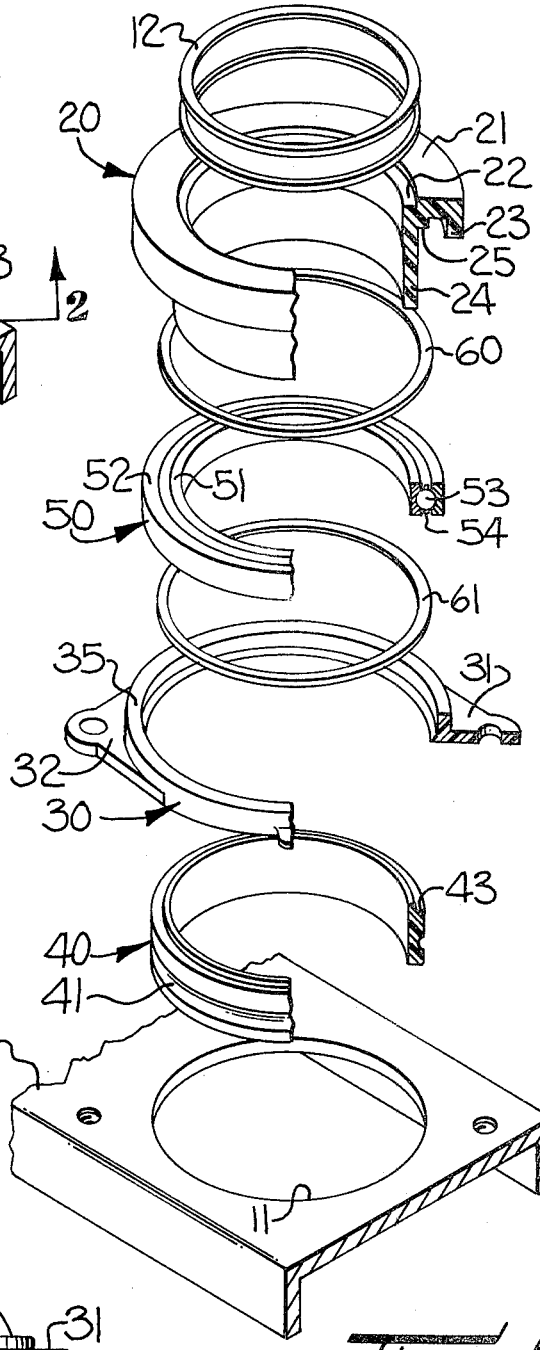
FIG. 3 is an exploded isometric view showing the main component parts of the present support assembly spaced above the ring rail and with parts broken away.

The ring rail 10 of the spinning frame has a plurality of spaced openings 11 therein for receiving a spinning ring 12 and a traveller 13 is supported for rotation on the spinning ring 12. The improved support assembly of the present invention includes three component parts which are injection molded of shock-absorbing thermoplastic material. As illustrated in FIG. 3, the thermoplastic component parts of the present improved support assembly include a spinning ring holder, broadly referred to at 20, a mounting bracket, broadly referred to at 30, and drive means, in the form of a drive sleeve, broadly indicated at 40. The support assembly also includes a conventional metallic ball bearing, broadly indicated at 50, and a pair of felt bearing seals 60, 61.

The molded components 20, 30 and 40 are each molded of a shock-absorbing thermoplastic material having high strength, excellent stiffness, even at elevated temperatures, exceptional dimensional stability, creep resistance, and vibration-dampening properties. Preferably the thermoplastic material has a relatively low coefficient of linear thermal expansion on the order of about 2 to $3.5\times10^{-5}$ in/in/°F., most desirably about 2.8 (test method D-696); a flexural modulus (dry) at 75° F. on the order of about 300,000 to 1,400,000 PSI, most desirably about 750,000 PSI; and a Rockwell hardness (R scale) in excess of about 100, most desirably about 121. One particularly suitable thermoplastic material exhibiting the desired properties is an engineered type 6 nylon composition preferably containing glass reinforcing glass fibers for enhanced mechanical properties and dimensional stability. One such commercially available composition material is Capron (a trademark of Allied Chemical Corporation) type 8231, which is an injection molding grade of type 6 nylon containing about 14% by weight of glass fibers. However, it is to be understood that other types of material, having similar characteristics, may be used.

The spinning ring holder 20 includes an upper circular base 21, which is provided with an inner peripheral surface with a groove 22 formed therein to receive and support the lower edge of the spinning ring 12. A peripheral flange 23 is formed integral with the outer peripheral surface of the circular base 21 and extends downwardly therefrom. A tubular portion 24 is integrally formed at its upper end with the inner peripheral surface of the circular base 21 and extends downwardly therefrom and through the opening 11 in the ring rail 10. An integrally formed bearing spacing pad or shoulder 25 is formed at the juncture of the lower surface of the circular base 21 and the upper end of the tubular portion 24 to provide proper spacing above the mounting bracket 30, in a manner to be presently described. One or more oil lubrication holes 26 may be provided in the ring holder 20, as illustrated in FIG. 2.

Figure 1:
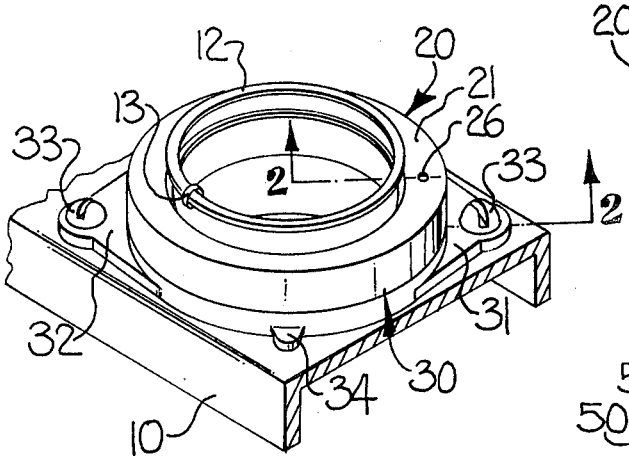
FIG. 1 is a fragmentary isometric view of a portion of the ring rail and illustrating the present support assembly fixed in position in one opening of the ring rail.

The mounting bracket 30 includes a pair of integrally formed and outwardly extending mounting ears 31, 32 for fixing the mounting bracket 30 on the ring rail 10, as by mounting screws 33 (FIG. 1). Outwardly extending stabilizing ears 34 are also integrally molded with the mounting bracket 30 and aid in stabilizing the position of the mounting bracket on the ring rail 10. The mounting bracket 30 also includes an inner peripheral vertical flange 35 extending upwardly and surrounding the opening 11 in the ring rail 10.

The drive sleeve 40 includes an inner peripheral surface which is adapted to be press fitted and/or adhesively secured on the outer peripheral surface of the tubular portion 24 of the ring holder 20. The outer peripheral surface of the sleeve 40 is provided with a peripheral groove 41 which is adapted to be drivingly engaged by a drive belt 42 (FIG. 2) which is preferably circular in cross-section and formed of polyurethane plastic material. The polyurethane plastic belt 42 has resilience and shock-absorbing characteristics that also contribute to the quiet, smooth-running operation of the support assembly and also provides a good frictional drive with the groove 41 of the drive sleeve 40. The belt 42 may be driven in any suitable manner, such as that disclosed in my co-pending application Ser. No. 71,720, the disclosure of which is incorporated herein by reference as an illustration of one type of drive which may be utilized in connection with the improved support assembly of the present invention.

Figure 2:
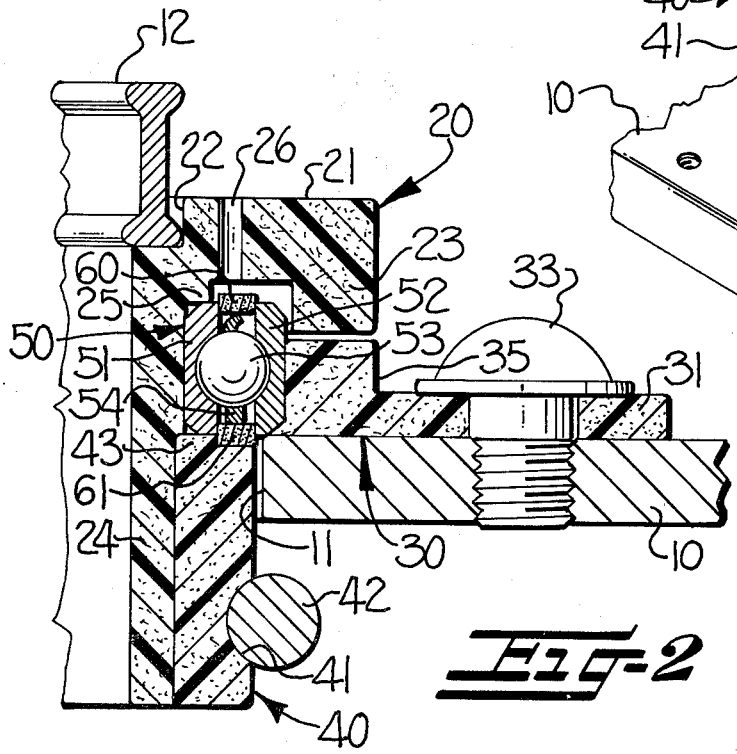
FIG. 2 is an enlarged fragmentary vertical sectional view taken substantially along the line 2—2 in FIG. 1.

The upper outer peripheral surface of the drive sleeve 40 is provided with a groove 43 which may be used for supporting the lower felt seal 61, as illustrated in FIG. 2. The ball bearing 50 includes an inner race 51 and an outer race 52 with bearing balls 53 supported therebetween in spaced-apart relationship by a retaining and spacing ring 54. As illustrated in FIG. 2, the upper end of the inner race 51 is in engagement with the spacing pad or shoulder 25 and the lower end of the inner race 51 is in engagement with the upper edge of the drive sleeve 40.

To assemble the present support assembly, it is preferred that the mounting bracket 30 be molded in position around the outer race 52 of the ball bearing with the upper portion of the bearing 50 extending upwardly therefrom, as illustrated in FIG. 2. However, the bearing 50 may be press fitted in the mounting bracket 30. The upper felt seal 60 is positioned above the bearing 50 and the inner race of the ball bearing 50 is press fitted up around the outer surface of the tubular portion 24 of the ring holder 20 until the upper surface of the inner race 51 is in engagement with the support pad or spacer 25. The outer surface of the upper end of the tubular portion 24 may be provided with a shoulder, as shown in FIG. 2, so that a tight fit is provided for the inner race 51 of the bearing 50.

In this position, the outer peripheral flange 23 of the circular base 21 extends downwardly over and covers a substantial portion of the outer race 52 of the ball bearing 50. The lower felt seal 61 is then positioned in the groove 42 at the upper end of the drive sleeve 40 and the drive sleeve 40 is press fitted and/or adhesively secured on the outer surface of the tubular portion 24 of the ring support 20. The sleeve 40 is pressed upwardly until the upper end of the drive sleeve 40 engages the lower portion of the inner race 51 of the ball bearing 50.

As shown in FIG. 2, the circular base 21 covers the upper end of the bearing 50 and the peripheral flange 23 extends downwardly around the upper portion of the outer race 52 of the bearing 50. Thus, the upper portion of the ring holder 20 extends over and covers the bearing 50.

The support assembly is then positioned in one of the openings in the ring rail 10 and the mounting bracket 30 is then fixed thereto by the screws 32. As illustrated in FIG. 2, the bearing is chamfered at each corner of both the inner and outer races and the inner periphery of the mounting bracket 30 extends inwardly to form a fillet or mating portion to provide a bearing stop for the chamfered lower surface of the outer race 52 of the bearing 50. Thus, the clearance space between the lower surface of the peripheral vertical flange 23 of the ring holder 20 and the upper surface of the peripheral vertical flange 35 of the mounting bracket 30 is aligned with substantially the medial portion of the outer race 52 of the bearing 50. Since the outer peripheral surface of the flange 23 and the vertical flange 35 are substantially vertically aligned, any lint falling downwardly is not likely to pass into the horizontal clearance between the rotating ring holder 20 and the stationary mounting bracket 30. Even if any lint, yarn or the like is drawn into the clearance space between the rotating ring support 20 and the fixed mounting bracket 30, it will merely engage the outer peripheral surface of the outer race 52 of the bearing 50 and will not interfere with the operation of the bearing or the rotating ring holder 20. Even if lint, string or the like should work its way inside of the flange 23, it will be prevented from interfering with the operation of the ball bearing 50 by the upper felt seal 60.

The relatively soft characteristic of the thermoplastic material from which the three main components 20, 30 and 40 are formed, operates to prevent interference fit and provides a long life for the ball bearing. The shock-absorbing characteristic of the material dampens any vibration which may be set up because of parts being not exactly round or exactly in balance. The formation of the component parts of the thermoplastic material also provides a support for rotating spinning rings which is much quieter in operation than a corresponding type of support assembly formed of metal.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a spinning frame including a ring rail having at least one opening therein for receiving a spinning ring supported for rotation at said opening in said ring rail, the combination therewith of a improved support assembly for said spinning ring comprising a spinning ring holder formed of shock-absorbing and vibration-dampening thermoplastic material, said spinning ring holder including an upper circular base including inner and outer peripheral surfaces with means for supporting said spinning ring in said inner peripheral surface of said circular base, a peripheral flange formed integral with said circular base and extending downwardly therefrom, a mounting bracket fixed on said ring rail and including an inner peripheral vertical flange surrounding said opening, said mounting bracket also being constructed of shock-absorbing and vibration-dampening thermoplastic material, ball bearing means including an outer race supported in said inner peripheral vertical flange of said mounting bracket and extending above the level of said inner peripheral vertical flange, the lower surface of said peripheral flange of said spinning ring holder terminating at approximately the medial portion of said outer race of said ball bearing means to define a clearance space extending inwardly between the lower surface of said peripheral flange of said spinning ring holder and the upper surface of said inner peripheral vertical flange of said mounting bracket, and an inner race supporting said spinning ring holder for rotation, and drive means for rotating said spinning ring holder.

2. In a spinning frame according to claim 1 wherein said spinning ring holder and said mounting bracket are molded of thermoplastic material containing glass fibers to add stability thereto.

3. In a spinning frame according to claim 1 wherein spinning ring holder includes a tubular portion formed integral with said inner peripheral surface and extending downwardly and through said opening, and wherein said drive means is drivingly connected to said tubular portion of said spinning ring holder.

4. In a spinning frame according to claim 3 wherein said drive means comprises a drive sleeve fixed on said tubular portion, a groove formed in the outer surface of said drive sleeve, and a drive belt in engagement with said groove in said drive sleeve.

5. In a spinning frame according to claim 4 wherein said groove in said drive sleeve is semi-circular, and wherein said drive belt is circular in cross-section and is formed of polyurethane plastic material.

6. In a spinning frame according to claim 1 including a first felt seal positioned above said ball bearing, and a second felt seal positioned below said ball bearing to prevent the entry of lint into said ball bearing.

7. In a spinning frame according to claim 1 including a spacing pad integrally formed with the lower surface of said circular base and being engaged by the upper edge of said inner race of said ball bearing for providing the proper clearance space between the lower surface of said peripheral flange and the upper surface of said mounting bracket.

8. In a spinning frame including a ring rail having at least one opening therein for receiving a spinning ring supported for rotation at said opening in said ring rail, the combination therewith of an improved support assembly for said spinning ring comprising a spinning ring holder formed of shock-absorbing and vibration-dampening thermoplastic material containing glass fibers to add stability thereto, said spinning ring holder including an upper circular base including inner and outer peripheral surfaces with means for supporting said spinning ring in said inner peripheral surface of said circular base, a tubular portion formed integral with said inner peripheral surface and extending downwardly through said opening, and a peripheral flange formed integral with said circular base and extending downwardly therefrom, a mounting bracket fixed on said ring rail and including an inner peripheral vertical flange surrounding said opening, said mounting bracket also being constructed of shock-absorbing and vibration-dampening thermoplastic material containing glass fibers to add stability thereto, ball bearing means including an outer race supported in said inner peripheral vertical flange of said mounting bracket, and an inner race surrounding said tubular portion and supporting said spinning ring holder for rotation, said ball bearing means extending upwardly above said mounting bracket and inside of said peripheral flange, and drive means drivingly connected to said tubular portion for rotating said spinning ring holder.

9. An improved support assembly for a spinning ring mounted for rotation around an opening in the ring rail of a spinning frame, said support assembly comprising a spinning ring holder formed of shock-absorbing and vibration-dampening thermoplastic material, said spinning ring holder including an upper circular base including inner and outer peripheral surfaces with means for supporting said spinning ring in said inner peripheral surface of said circular base, a peripheral flange formed integral with said circular base and extending downwardly therefrom, a mounting bracket adapted to be fixed on said ring rail and including an inner peripheral vertical flange adapted to surround the opening, said mounting bracket also being constructed of shock-absorbing and vibration-dampening thermoplastic material, ball bearing means including an outer race supported in said inner peripheral vertical flange of said mounting bracket and extending above the level of said inner peripheral vertical flange, said peripheral flange of said spinning ring holder downwardly and around said outer race of said ball bearing means, said peripheral flange of said spinning ring holder and said peripheral vertical flange of said mounting bracket each including peripheral surfaces being substantially vertically aligned so that any downwardly falling lint is not likely to pass inwardly and between the lower surface of said peripheral flange of said spinning ring holder and the upper surface of said peripheral vertical flange of said mounting bracket, and an inner race supporting said spinning ring holder for rotation.

10. An improved support assembly according to claim 9 wherein said thermoplastic material forming said ring holder and said mounting bracket contains glass fibers to add stability thereto, wherein said ring holder includes a tubular portion formed integral with said inner peripheral surface and adapted to extend downwardly through the opening in the ring rail, and a peripheral flange formed integral with said circular base and extending downwardly therefrom, said ball bearing means extending upwardly above said mounting bracket and inside of said peripheral flange, and wherein said drive means is drivingly connected to said tubular portion of said ring holder.

* * * * *